US007306648B2

(12) United States Patent
Kiern et al.

(10) Patent No.: US 7,306,648 B2
(45) Date of Patent: Dec. 11, 2007

(54) RETAINER FOR USE WITH A CORONA GROUND ELEMENT OF AN ELECTROSTATIC PRECIPITATOR

(75) Inventors: Bruce M. Kiern, Gulfport, MS (US); Dennis T. Lamb, Long Beach, MS (US); Charles W. Reynolds, Long Beach, MS (US); Christopher M. Paterson, Biloxi, MS (US)

(73) Assignee: Oreck Holdings, LLC, Cheyenne, WY (US)

( * ) Notice: Subject to any disclaimer, the term of this patent is extended or adjusted under 35 U.S.C. 154(b) by 0 days.

(21) Appl. No.: 11/405,751

(22) Filed: Apr. 18, 2006

(65) Prior Publication Data

US 2007/0240573 A1 Oct. 18, 2007

(51) Int. Cl.
*B03C 3/86* (2006.01)

(52) U.S. Cl. ..... 95/57; D8/399; 96/83; 96/95; 411/147

(58) Field of Classification Search ..... 96/83, 96/86, 87, 95, 96, 98; 95/57, 79; 411/147, 411/155, 160–162; D8/399
See application file for complete search history.

(56) References Cited

U.S. PATENT DOCUMENTS

| | | | | |
|---|---|---|---|---|
| 851,964 | A * | 4/1907 | Rosenkranz | 411/136 |
| 1,251,832 | A * | 1/1918 | Spencer | 411/129 |
| 1,641,059 | A * | 8/1927 | Tausch | 411/155 |
| 1,793,116 | A * | 2/1931 | Monroe | 411/155 |
| 2,072,176 | A * | 3/1937 | Monroe | 411/155 |
| 2,362,716 | A | 11/1944 | Phillips | |
| 2,675,844 | A * | 4/1954 | Knohl | 411/155 |
| 3,175,341 | A * | 3/1965 | Winter | 96/86 |
| 3,631,910 | A * | 1/1972 | Crowther et al. | 411/149 |
| 3,856,066 | A * | 12/1974 | Reynolds | 411/155 |
| 4,253,852 | A | 3/1981 | Adams | |
| 4,326,861 | A | 4/1982 | Matsumoto | |
| 4,516,991 | A | 5/1985 | Kawashima | |
| 4,569,685 | A | 2/1986 | Cottrell | |
| D313,171 | S * | 12/1990 | Hudson | D8/399 |
| 5,035,728 | A | 7/1991 | Fang | |
| 5,330,559 | A | 7/1994 | Cheney et al. | |

(Continued)

FOREIGN PATENT DOCUMENTS

| | | |
|---|---|---|
| AT | 191042 B | 7/1957 |

(Continued)

OTHER PUBLICATIONS

Friedrich; C-90A Electronic Air Cleaner 2003; pp. 1-12; Friedrich Air Conditioning Co., 4200 North Pan Am Expressway, San Antonio, Texas 78218-5212; www.friedrich.com; USA.

*Primary Examiner*—Richard L. Chiesa
(74) *Attorney, Agent, or Firm*—The Ollila Law Group LLC

(57) ABSTRACT

A retainer for use with a corona ground element of an electrostatic precipitator is provided according to an embodiment of the invention. The retainer includes a body and a retainer aperture extending at least partially through the body and adapted to receive a projection extending from the corona ground element. The retainer aperture is configured to receive the projection as a press fit.

20 Claims, 17 Drawing Sheets

U.S. PATENT DOCUMENTS

| | | | | | |
|---|---|---|---|---|---|
| 5,433,772 | A | * | 7/1995 | Sikora | 96/87 |
| 5,669,963 | A | | 9/1997 | Horton et al. | |
| 5,934,855 | A | * | 8/1999 | Osterle et al. | 411/545 |
| 6,163,098 | A | | 12/2000 | Taylor et al. | |
| 6,176,977 | B1 | | 1/2001 | Taylor et al. | |
| 6,312,507 | B1 | | 11/2001 | Taylor et al. | |
| 6,350,417 | B1 | | 2/2002 | Lau et al. | |
| 6,544,485 | B1 | | 4/2003 | Taylor | |
| 6,632,407 | B1 | | 10/2003 | Lau et al. | |
| 6,709,484 | B2 | | 3/2004 | Lau et al. | |
| 6,713,026 | B2 | | 3/2004 | Taylor et al. | |
| 2002/0079212 | A1 | | 6/2002 | Taylor et al. | |
| 2002/0098131 | A1 | | 7/2002 | Taylor et al. | |
| 2002/0141914 | A1 | | 10/2002 | Lau et al. | |
| 2003/0010211 | A1 | | 1/2003 | Yu | |
| 2003/0170150 | A1 | | 9/2003 | Lau et al. | |
| 2003/0196887 | A1 | | 10/2003 | Lau et al. | |
| 2003/0209420 | A1 | | 11/2003 | Taylor et al. | |
| 2004/0003721 | A1 | | 1/2004 | Lau et al. | |
| 2004/0033340 | A1 | | 2/2004 | Lau et al. | |
| 2004/0057882 | A1 | | 3/2004 | Lau et al. | |
| 2004/0079233 | A1 | | 4/2004 | Lau et al. | |

FOREIGN PATENT DOCUMENTS

| | | | | | |
|---|---|---|---|---|---|
| BE | 487359 | A | | 2/1949 | |
| DE | 503495 | C | | 7/1930 | |
| DE | 1076086 | B | | 2/1960 | |
| JP | 4-171064 | A | * | 6/1992 | 96/96 |
| JP | 5-161857 | A | * | 6/1993 | 96/95 |

* cited by examiner

RETAINER FOR USE WITH A CORONA GROUND ELEMENT OF AN ELECTROSTATIC PRECIPITATOR

TECHNICAL FIELD

The present invention relates to an electrostatic precipitator, and more particularly, to a retainer for an electrostatic precipitator.

BACKGROUND OF THE INVENTION

Air cleaners and purifiers are widely used for removing foreign substances from air. The foreign substances can include pollen, dander, smoke, pollutants, dust, etc. In addition, an air cleaner can be used to circulate room air. An air cleaner can be used in many settings, including at home, in offices, etc.

One type of air cleaner is an electrostatic precipitator. An electrostatic precipitator operates by creating an electrical field. Dirt and debris in the air becomes ionized when it is brought into the electrical field by an airflow. Charged positive and negative electrodes in the electrostatic precipitator air cleaner, such as positive and negative plates or positive and grounded plates, create the electrical field and one of the electrode polarities attracts the ionized dirt and debris. Periodically, the electrostatic precipitator can be removed and cleaned. Because the electrostatic precipitator comprises electrodes or plates through which airflow can easily and quickly pass, only a low amount of energy is required to provide airflow through the electrostatic precipitator. As a result, foreign objects in the air can be efficiently and effectively removed without the need for a mechanical filter element. However, the prior art electrostatic precipitator element offers a limited distance of airflow travel over which to ionize and remove dirt and debris entrained in the airflow.

FIG. 1 shows a prior art electrostatic precipitator 100 that includes an electrostatic precipitator cell 101 and a pre-ionizer stage 120. The prior art electrostatic precipitator cell 101 includes charge plates 102 that are electrically connected to a voltage source 104 and grounded collection plates 103. The charge plates 102 and the collection plates 103 are substantially parallel and spaced-apart, wherein airflow can move between the plates. The prior art pre-ionizer 120 comprises corona charge elements 126 located in the airflow before (i.e., in front of) the charge plates 102 and the collection plates 103. The corona charge elements 126 are typically aligned with or are co-planar with the charge plates 102. In the prior art the corona charge elements 126 are energized by the same voltage source 104 as the charge plates 102 and at the same voltage potential. The pre-ionizer 120 at least partially ionizes the airflow and the entrained particulate before the airflow enters the electrostatic precipitator cell 101, thereby increasing the particulate-removing efficiency of the prior art electrostatic precipitator 100.

A drawback of the prior art pre-ionizer 120 is that the pre-ionizing electrical field is created behind/downstream of the corona charge elements 126 and between the corona charge elements 126 and the collection plates 103. As a result, regions of the airflow may be only partly or minimally pre-ionized. Another drawback is that in the prior art, the voltage potential on the corona charge elements 126 is typically the same voltage level as the charge plates 102 (i.e., the prior art corona charge elements 126 are attached to or in contact with the charge plates 102). The ionization level of the prior art pre-ionizer 120 may therefore be only as effective and efficient as the ionization created by the charge plates 102 and the collection plates 103 of the prior art electrostatic precipitator 100.

FIG. 17 shows a prior art corona wire loop end of a corona wire used in a prior art electrostatic precipitator. The prior art corona wire loop end is crimped onto the prior art corona wire, and slips over some manner of tongue or tab of the prior art electrostatic precipitator during assembly.

However, the prior art corona wire and prior art corona wire loop end have drawbacks. The prior art corona wire loop end is relatively complicated in design and therefore costly to manufacture. The prior art corona wire loop end can slip off of the corresponding tab if too much tension is placed on the prior art corona wire. The prior art corona wire loop end includes unnecessary structure. The prior art corona wire loop end is relatively wide, and introduces a possibility of arcing to adjacent components when a high voltage is placed on the prior art corona wire.

SUMMARY OF THE INVENTION

A retainer adapted for use with a corona ground element of an electrostatic precipitator is provided according to an embodiment of the invention. The retainer comprises a body and a retainer aperture extending at least partially through the body and adapted to receive a projection extending from the corona ground element. The retainer aperture is configured to receive the projection as a press fit.

A retainer adapted for use with a corona ground element of an electrostatic precipitator is provided according to an embodiment of the invention. The retainer comprises a body, a sleeve portion extending from the body and adapted to fit into a ground element aperture of the electrostatic precipitator, and a retainer aperture extending at least partially through the sleeve portion and adapted to receive a projection extending from the corona ground element.

A method of forming a retainer for use with a corona ground element of an electrostatic precipitator is provided according to the invention. The method comprises forming a body and forming a retainer aperture extending at least partially through the body and adapted to receive a projection extending from the corona ground element. The retainer aperture is configured to receive the projection as a press fit.

A method of forming a retainer for use with a corona ground element of an electrostatic precipitator is provided according to the invention. The method comprises forming a body, forming a sleeve portion extending from the body and adapted to fit into a ground element aperture of the electrostatic precipitator, and forming a retainer aperture extending at least partially through the sleeve portion and configured to receive a projection extending from the corona ground element.

BRIEF DESCRIPTION OF THE DRAWINGS

The same reference number represents the same element on all drawings. It should be noted that the drawings are not necessarily to scale.

DETAILED DESCRIPTION OF THE INVENTION

FIGS. 2-16 and the following descriptions depict specific embodiments to teach those skilled in the art how to make and use the best mode of the invention. For the purpose of teaching inventive principles, some conventional aspects have been simplified or omitted. Those skilled in the art will appreciate variations from these embodiments that fall within the scope of the invention. Those skilled in the art will also appreciate that the features described below can be combined in various ways to form multiple variations of the invention. As a result, the invention is not limited to the specific embodiments described below, but only by the claims and their equivalents.

Figure 1:
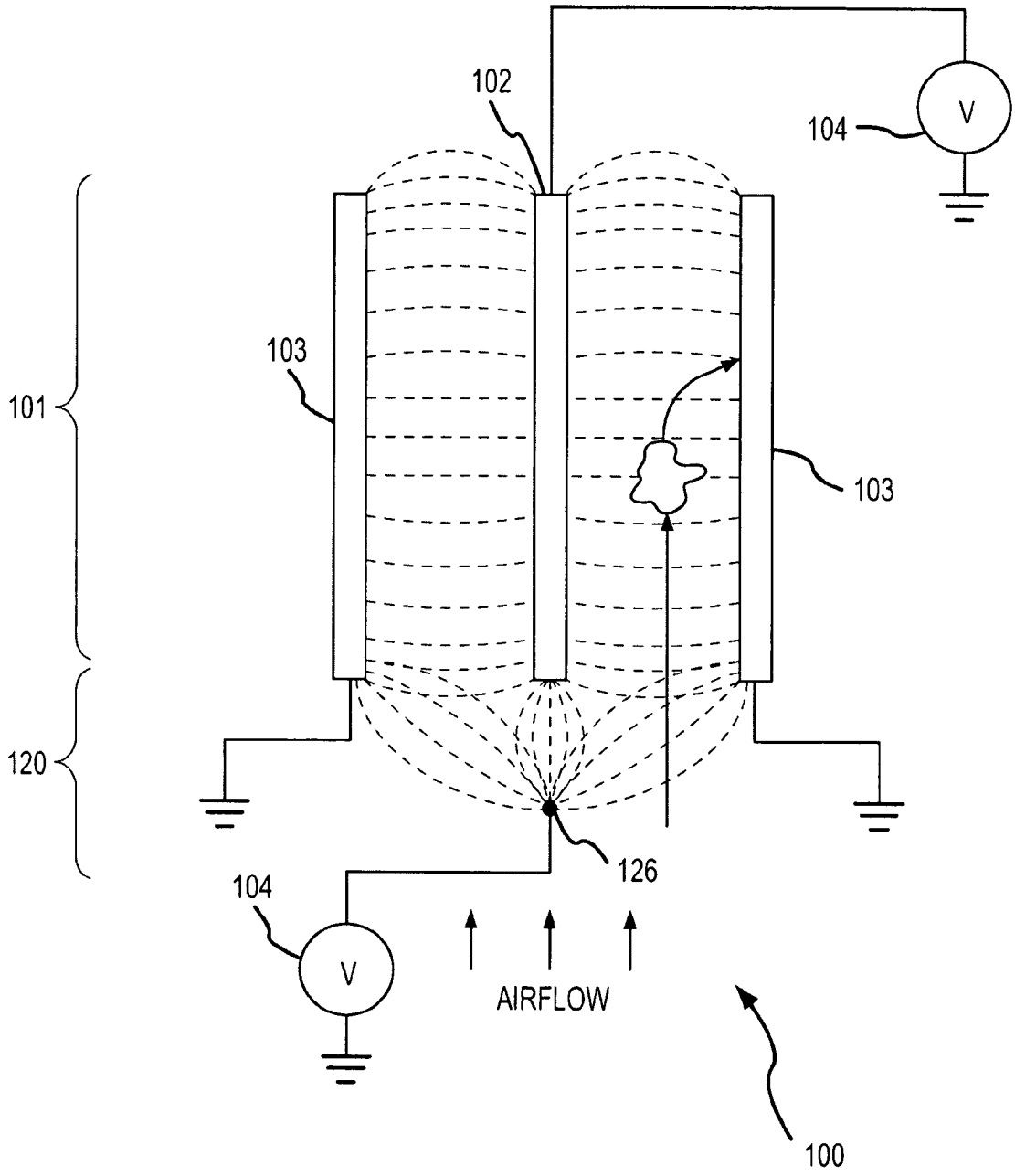
PRIOR ART FIG. 1
FIG. 1 shows a prior art electrostatic precipitator that includes an electrostatic precipitator cell and a pre-ionizer stage.
Figure 2:
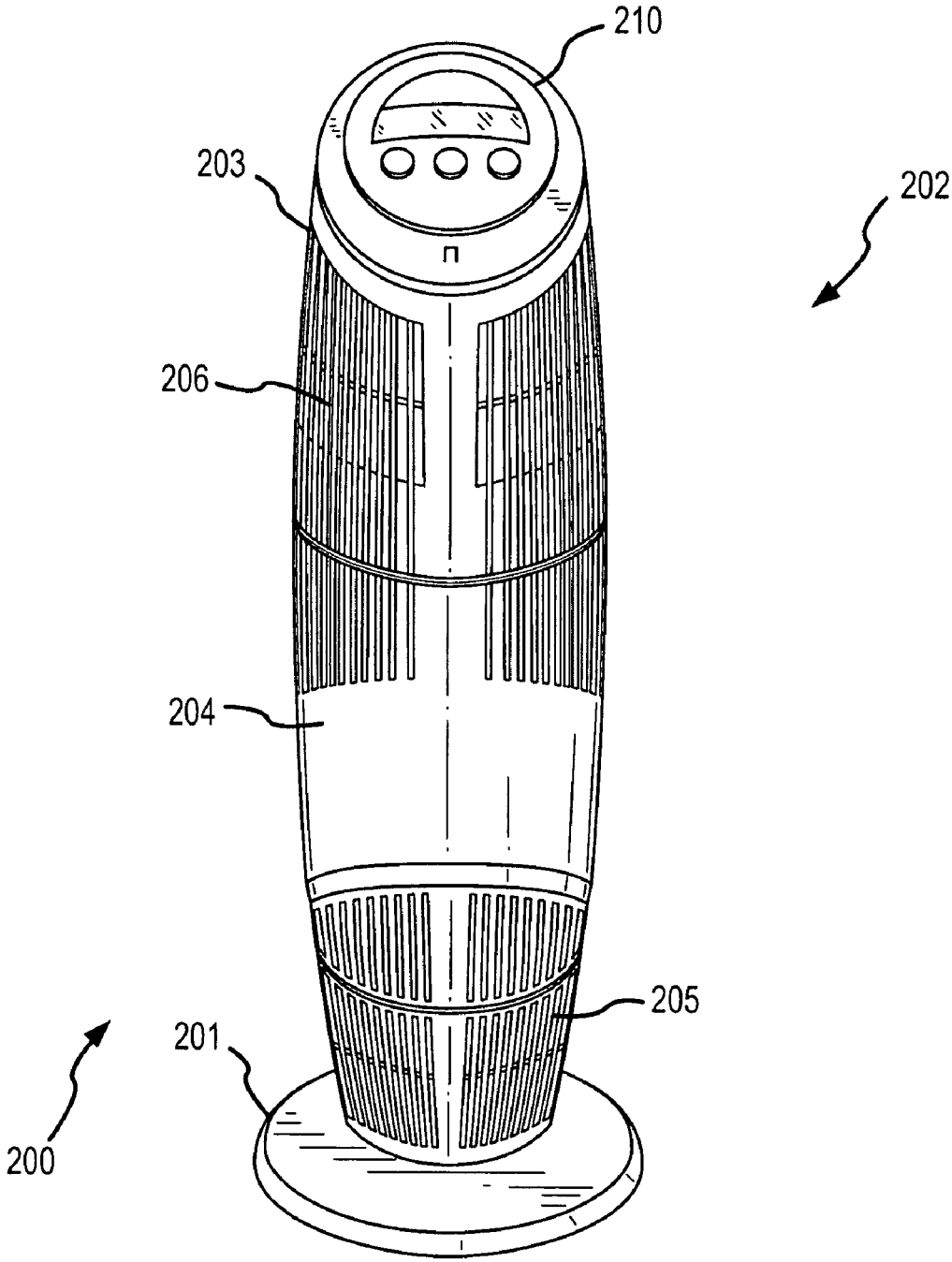
FIG. 2 shows a tower air cleaner according to an embodiment of the invention.

FIG. 2 shows a tower air cleaner 200 according to an embodiment of the invention. The tower air cleaner 200 includes a base portion 201 and a tower portion 202. The tower portion 202 can be generally vertically positioned and elongate in shape. In one embodiment, the tower portion 202 can be substantially cylindrical in shape. The tower portion 202 includes a shell 203, one or more doors 204, and a control panel 210. The tower portion 202 further includes an air inlet 205 and an air outlet 206. Air is drawn in through the air inlet 105, is cleaned inside the tower portion 202, and the cleaned air is exhausted from the air outlet 206.

The air inlet 205 is shown as being at the lower end of the tower portion 202. However, it should be understood that alternatively the relative positions of the air inlet 205 and the air outlet 206 could be interchanged.

Figure 3:
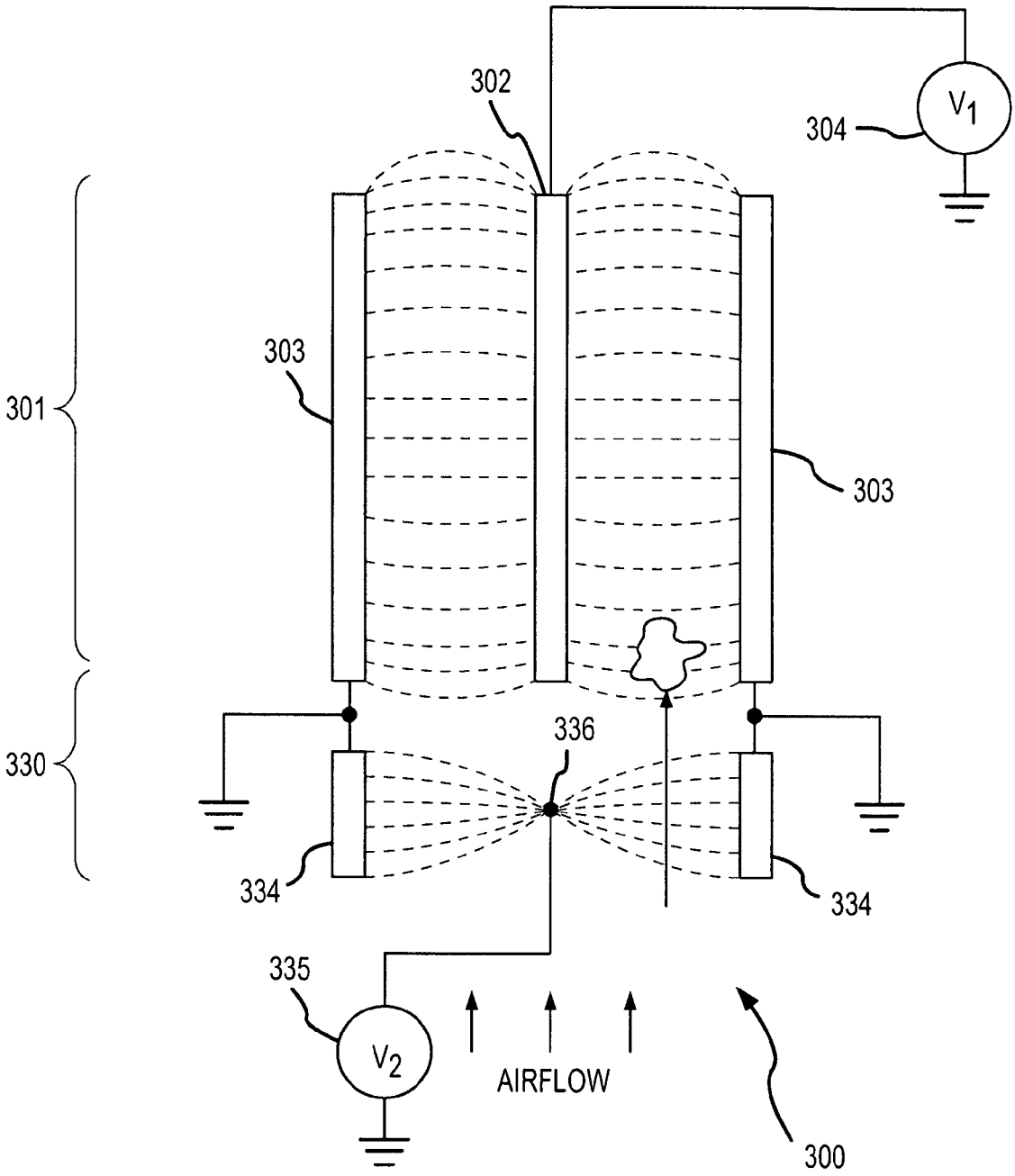
FIG. 3 shows an electrostatic precipitator according to an embodiment of the invention.

FIG. 3 shows an electrostatic precipitator 300 according to an embodiment of the invention. The electrostatic precipitator 300 includes an electrostatic precipitator cell 301 and a pre-ionizer 330. The electrostatic precipitator cell 301 includes one or more charge plates 302, one or more collection plates 303, and a first voltage source 304. The pre-ionizer 330 includes one or more corona charge elements 336, two or more corona ground elements 334, and a second voltage source 335. The corona ground elements 334 can be arranged in a substantially parallel orientation and the corona charge elements 336 can be substantially centered between adjacent corona ground elements 334. The corona charge elements 336 can be substantially equidistant from adjacent corona ground elements 334 and the corona charge elements 336 can be substantially laterally centered on the adjacent corona ground elements 334.

In one embodiment, because the corona ground elements 334 are separate from one another, they can also be charged differently from one another. For example, the corona ground elements 334 and the corona charge elements 336 in the central portion of the electrostatic precipitator cell 301 can be at a higher voltage potential than the same components at the edge of the electrostatic precipitator cell 301. This can be done in order to lessen the probability of electrical discharges, for example. As a result, the pre-ionizer 330 provides a better control of electrical potential and electrical current between the corona ground elements 334 and the corona charge elements 336.

In operation, a first voltage potential $V_1$ is placed across the electrostatic precipitator cell 301 by the first voltage source 304, creating one or more first electrical fields (see upper set of dashed lines). In addition, a second voltage potential $V_2$ is placed across the pre-ionizer 330 by the second voltage source 335, creating a second electrical field (see lower set of dashed lines). Therefore, air traveling through the electrostatic precipitator 300 (from bottom to top in the figure) is ionized by the combined first and second voltage potentials as the airflow passes through the pre-ionizer 330 and through the electrostatic precipitator cell 301. As a consequence, dirt and debris entrained in the airflow is charged (typically a positive charge) and the charged dirt and debris is attracted to the one or more collection plates 303. The airflow, now without the dirt and debris, passes through the electrostatic precipitator 300 and is exhausted from the electrostatic precipitator 300 in a substantially cleaned condition.

The second voltage source 335 can provide a same or different voltage potential than the first voltage source 304 (i.e., $V_1=V_2$ or $V_1 \neq V_2$). In one embodiment, the second voltage source 335 provides a higher voltage potential than the first voltage source 304 (i.e., $V_2>V_1$). For example, the second voltage source 335 can provide about twice the voltage level as the first voltage source 304, such as about 8,000 volts versus about 4,000 volts in one embodiment. However, it should be understood that the second voltage potential $V_2$ can comprise other voltage levels.

It should be understood that the pre-ionizer 330 can be formed of any number of corona ground elements 334 and corona charge elements 336. The corona ground elements 334 can be positioned in a substantially coplanar alignment with the collection plates 303 of the electrostatic precipitator cell 301, while the corona charge elements 336 can be positioned in a substantially coplanar alignment with the charge plates 302. Each corona charge element 336 can be substantially centered between two opposing corona ground elements 334. A corona charge element 336 in one embodiment can be substantially vertically centered in the figure with regard to the corona ground elements 334 in order to optimize the produced electrical field. The corona charge elements 336 are shown and discussed below in conjunction with FIGS. 7A-7B. The corona ground elements 334 are shown and discussed below in conjunction with FIGS. 13-15, and any of the various corona ground elements 334 can be used in the pre-ionizer 330.

In operation, the pre-ionizer 330 forms electrical fields between the corona charge elements 336 and the corresponding pair of corona ground elements 334. The dashed lines in the figure approximately represent these electrical fields, and illustrate how the electrical field lines are substantially perpendicular to the airflow and are substantially uniform between the corona charge elements 336 and the corresponding corona ground elements 334. The electrical field of the pre-ionizer 330 can at least partially ionize the airflow before the airflow travels through the electrostatic precipitator cell 301. This increases the surface area of the collection plates 303 that will collect particulate from the airflow. The effectiveness and efficiency of the electrostatic precipitator 300 is thereby greatly increased. In addition, the second voltage potential $V_2$ placed on the pre-ionizer 330 by the voltage source 335 can be independent of the first voltage potential $V_1$ placed on the electrostatic precipitator cell 301 by the voltage source 304. Consequently, the second voltage potential $V_2$ can be greater or much greater than the first voltage potential $V_1$.

Figure 4:
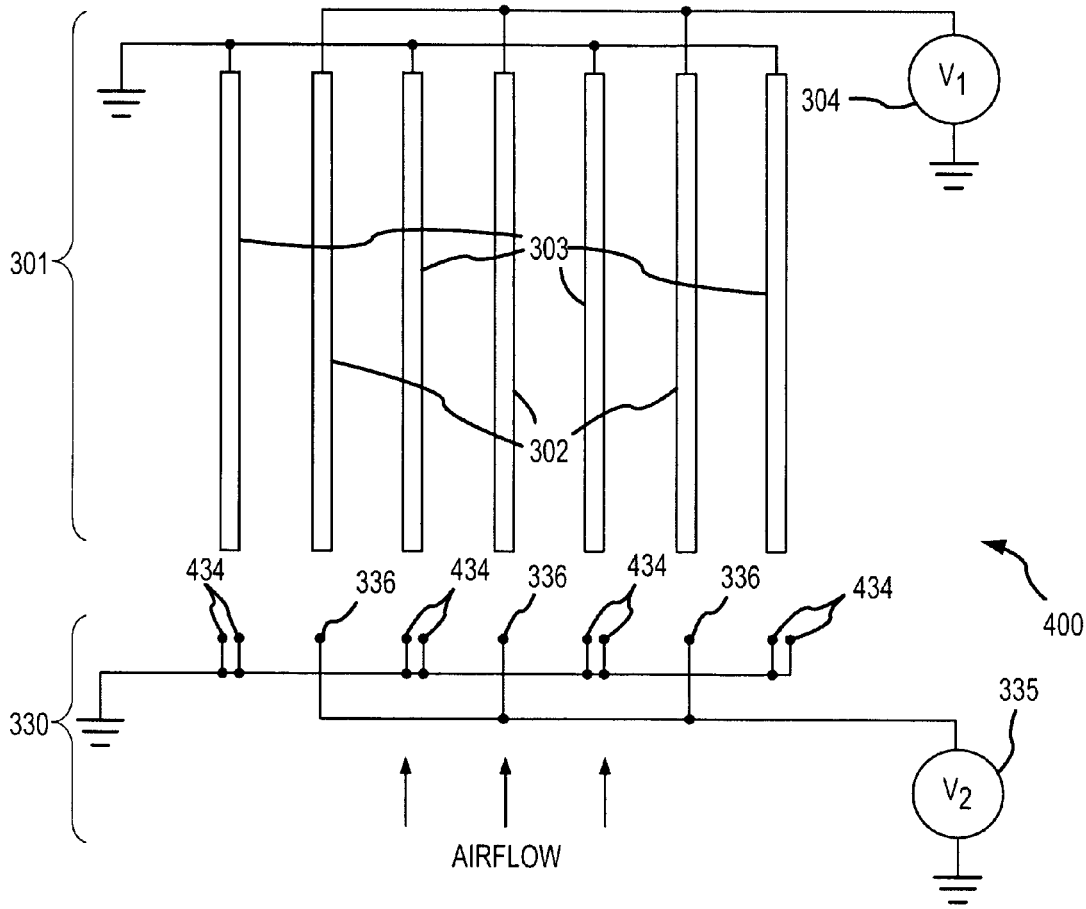
FIG. 4 shows an electrostatic precipitator according to another embodiment of the invention.

FIG. 4 shows an electrostatic precipitator 400 according to another embodiment of the invention. In this embodiment, the pre-ionizer 330 includes the corona charge elements 336 and pairs of ground wires 434 instead of the corona ground elements 334. The pairs of ground wires 434 in one embodiment are positioned substantially at the two exterior surfaces of the corona ground elements 334 of FIG. 3, wherein the distance from a corona charge element 336 to an adjacent ground wire 434 is substantially maintained (i.e., the distance from a corona charge element 336 to an adjacent ground wire 434 in this figure is approximately equal to the distance from a corona charge element 336 to an adjacent corona plate 334 in FIG. 3 and wherein a corona charge element is substantially equidistant from two adjacent corona ground element wire pairs). The operation of the pre-ionizer 330 in this embodiment is the same as previously discussed.

Figure 5:
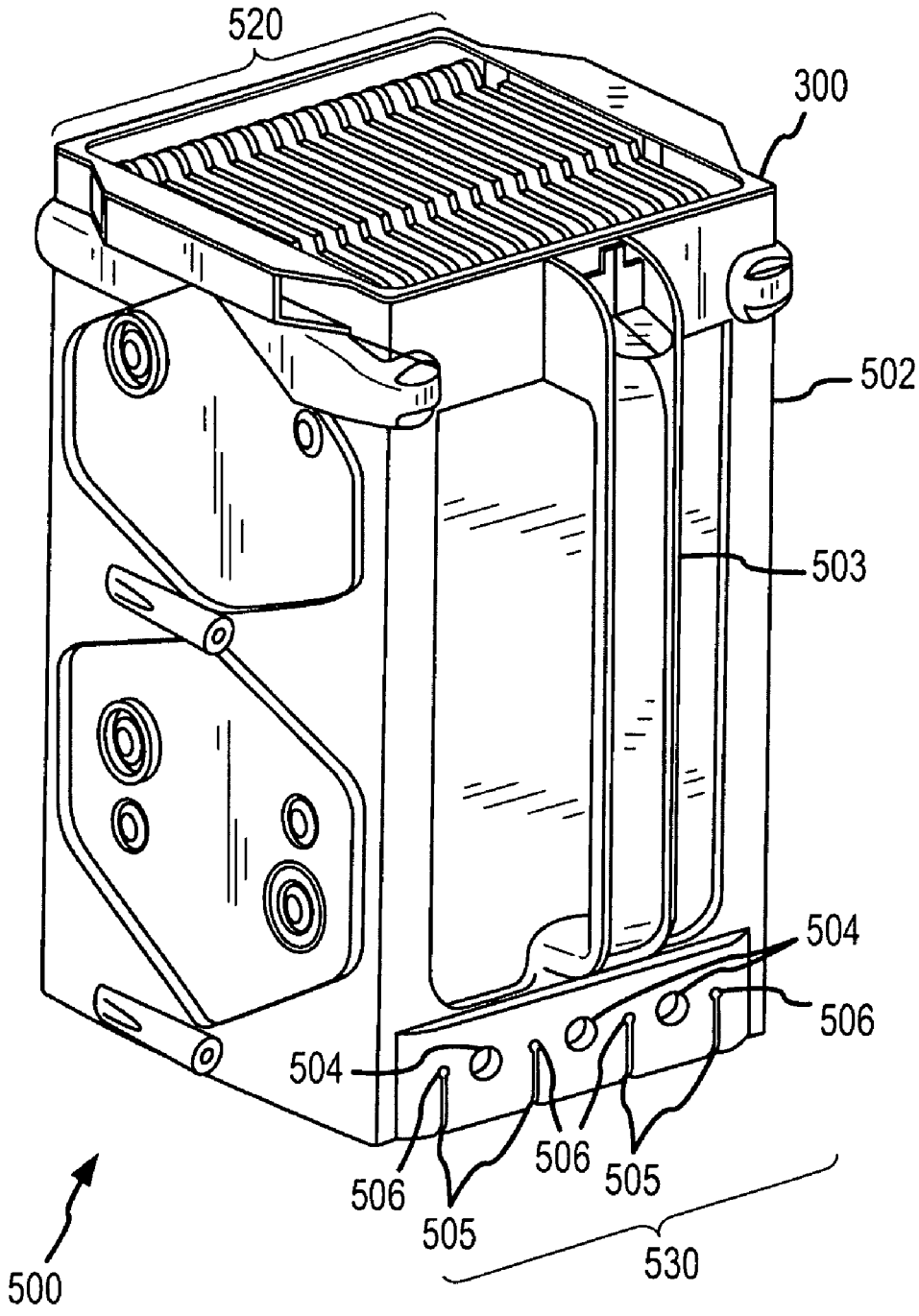
FIG. 5 shows an electrostatic precipitator assembly according to an embodiment of the invention.

FIG. 5 shows an electrostatic precipitator assembly 500 according to an embodiment of the invention. The electrostatic precipitator assembly 500 includes an electrostatic precipitator 300 in a frame 502 that can include a handle 503. The electrostatic precipitator assembly 500 includes a top opening 520 and a bottom opening 530 that enable the airflow to pass through the electrostatic precipitator 300. The frame 502 further includes ground element apertures 504 and charge element slots 505 and corresponding slot wells 506. The ground element apertures 504 receive a portion of the corona ground elements 334 in order to hold the corona ground elements 334 in the frame 502 (see FIG. 6). The charge element slots 505 and the slot wells 506 receive retaining bodies 704 formed on the ends of the corona charge elements 336 (see FIGS. 7A-7B) in order to hold the corona charge elements 336 in the frame 502.

Figure 6:
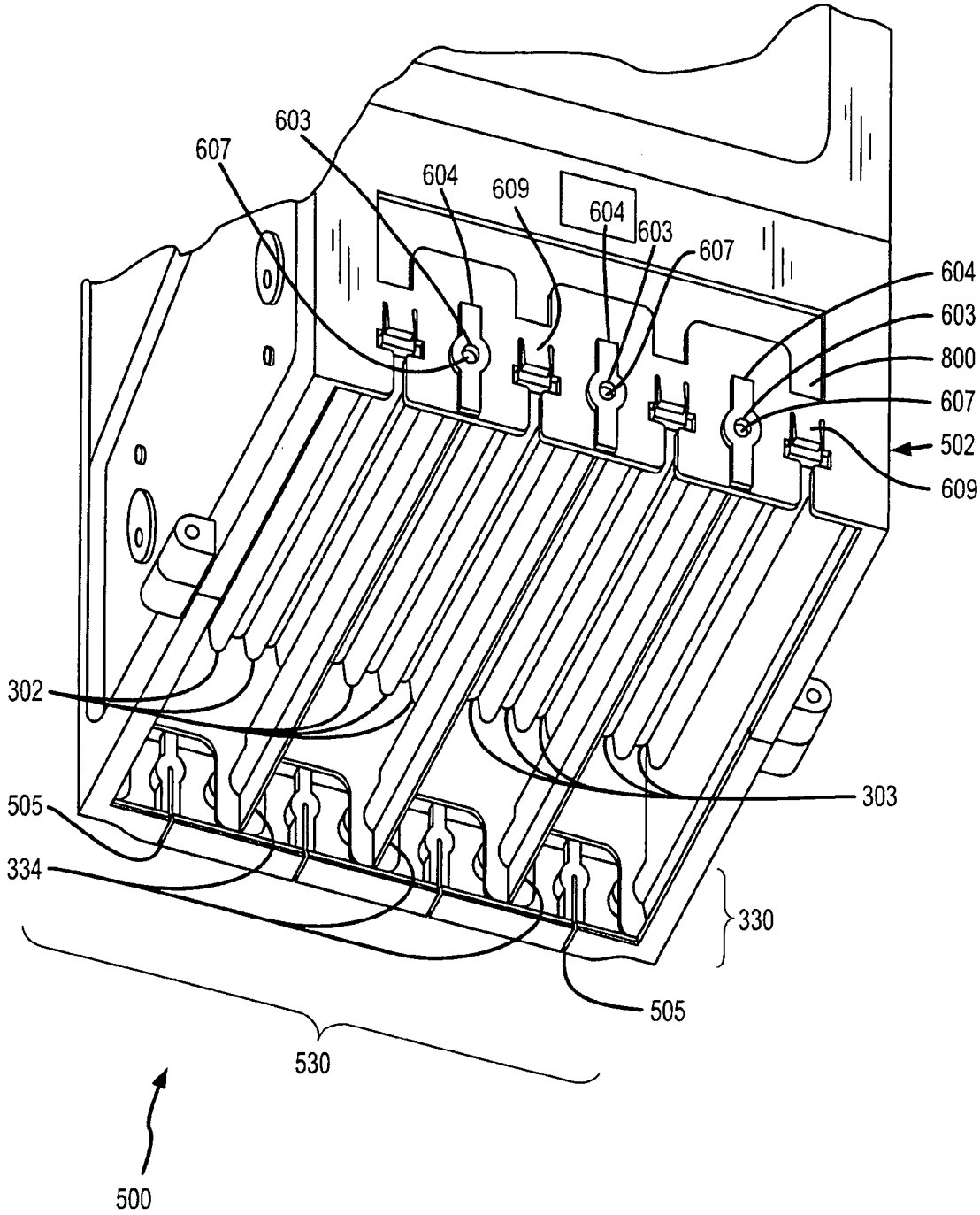
FIG. 6 is a bottom view of the electrostatic precipitator assembly of FIG. 5 looking up into a bottom opening.

FIG. 6 is a bottom view of the electrostatic precipitator assembly 500 of FIG. 5 looking up into the bottom opening 530. This figure shows the alternating charge plates 302 and collection plates 303. This figure also shows a portion of the pre-ionizer stage 330, including the corona ground elements 334. The corona ground elements 334 in one embodiment can include projections 607, such as stub shafts or other projections (see FIG. 14A). These projections 607 can engage the corresponding ground element apertures 504 formed in the frame 502 in the embodiment shown. In one embodiment, the frame 502 includes retainers 604 and retainer apertures 603 that receive the projections 607 of the corona ground elements 334 and further engage the frame 502, thereby retaining the corona ground elements 334 in the frame 502. In one embodiment, the retainers 604 engage the ground element apertures 504 through a snap fit or some manner of spring biasing. In another embodiment, the retainers 604 are inserted into the ground element apertures 504 as a press fit requiring an insertion force to press the retainers 604 into the ground element apertures 504. It can be seen from the figure that the projections 607 of the corona ground elements 334 in one embodiment do not fully extend through the ground element apertures 504 and do not extend out of the retainer apertures 603. Alternatively, in another embodiment (not shown), fasteners can pass through the retainers 604 and engage threaded apertures 608 in the corona ground elements 334 (see FIG. 14B).

Figure 7A:
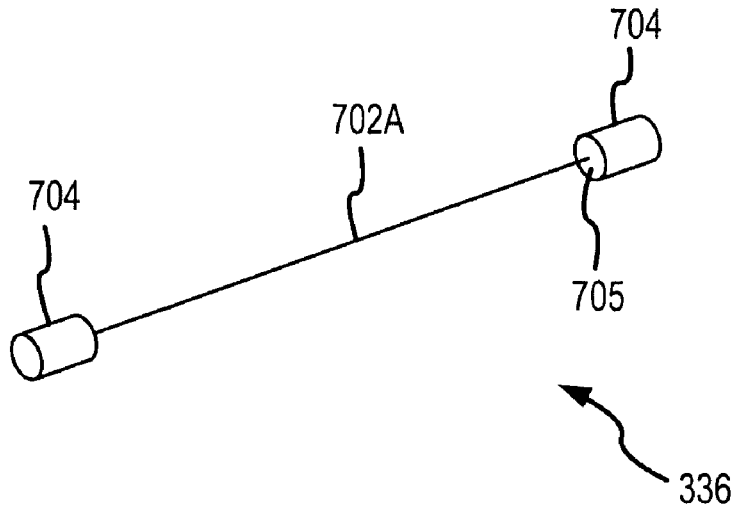
FIGS. 7A-7B show corona charge elements according to two embodiments of the invention.
Figure 7B:
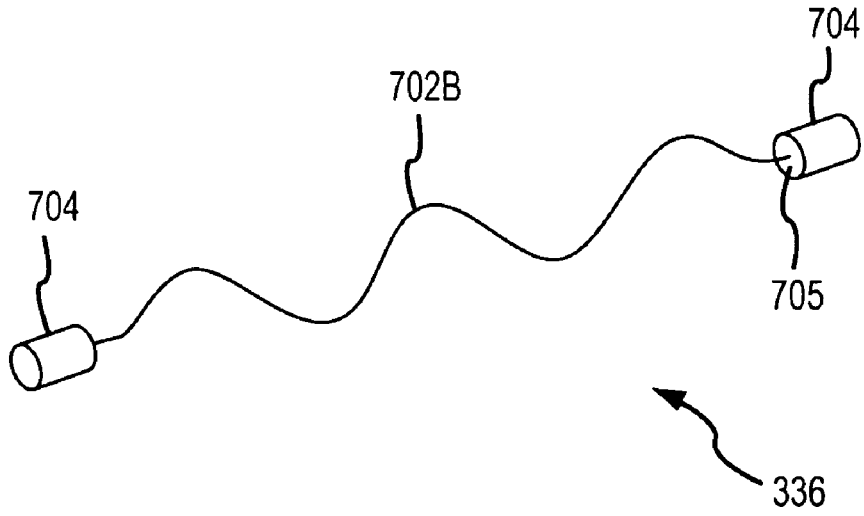

FIGS. 7A-7B show corona charge elements 336 according to two embodiments of the invention. In the two embodiments shown, a corona charge element 336 comprises an electrode wire 336. The corona charge element 336 includes a wire portion 702 and two retaining bodies 704 formed on the ends of the wire portion 702. A retaining body 704 is used to trap and retain an end of the wire portion 702.

A retaining body 704 comprises a mass, shape, bead, barrel, block, billet, etc., that is substantially solid and that is larger than the wire portion 702. A retaining body 704 can comprise a shape that is substantially spherical, cylindrical, rectangular, irregular, etc. A retaining body 704 includes a substantial length, height, and depth. A retaining body 704 includes a contact face 705 that contacts a retaining surface of the electrostatic precipitator 300. In one embodiment, the contact face 705 is substantially planar and extends substantially perpendicularly from the wire portion 702. Alternatively, the contact face 705 can curve or slope away from the wire portion 702. The contact face 705 in one embodiment includes a contact face area that is at least twice a cross-sectional area of the wire portion 702.

In use, the retaining body 704 is placed behind a retaining portion such as a wall or lip, wherein the wire portion 702 extends through some manner of slot or gap in the retaining portion. Consequently, the retaining body 704 can be trapped in order to retain the end of the corona charge element 336, and even can be used to place a tension force on the corona charge element 336.

In FIG. 7A, the corona charge element 336 in the embodiment shown includes a substantially straight wire portion 702A. In FIG. 7B, the wire portion 702B is substantially serpentine. The wire portion 702B in this embodiment may be substantially rigid or substantially inflexible in order to retain the serpentine shape.

The wire portion 702 can be formed of any metal or alloy composition, and can have any desired diameter and flexibility. The length of the corona charge element 336 can be such that the frame 502 places a tension on the corona charge element 336 when in place in the frame (see FIG. 11 and the accompanying discussion). The retaining bodies 704 are larger in diameter than the wire portion 702, and therefore can be used to restrain the corona charge element 336 by the two ends.

Figure 8:
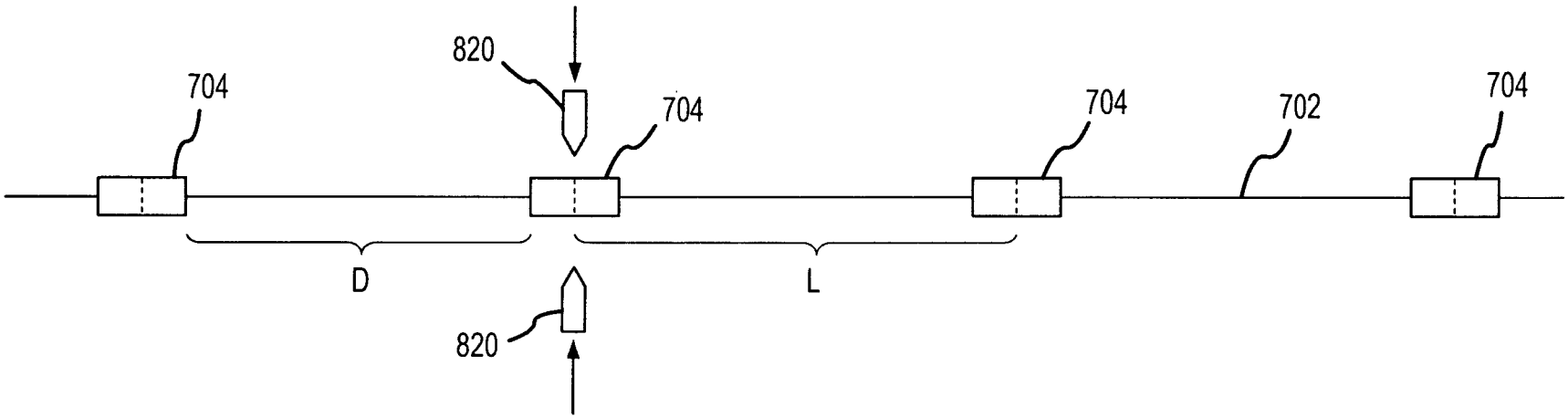
FIG. 8 shows a method of forming a corona charge element according to an embodiment of the invention.

FIG. 8 shows a method of forming the corona charge element 336 according to an embodiment of the invention. Although this figure and the next figure show straight wire portions 702A, it should be understood that both methods can equally apply to a substantially serpentine wire portion 702B.

The method in this figure comprises forming a plurality of spaced-apart retaining body elements 704 on a wire portion 702, with the spaced-apart retaining body elements 704 being separated from each other by a predetermined distance D. The method further comprises shearing apart each retaining body element 704. The shearing in one embodiment comprises shearing a retaining body element 704 into two substantially equal portions. Two shearing operations form an individual corona charge element 336. The corona charge element 336 thus formed includes a predetermined length L, a first retaining body formed substantially at a first end of the corona charge element 336, and a second retaining body formed substantially at a second end.

Figure 9:
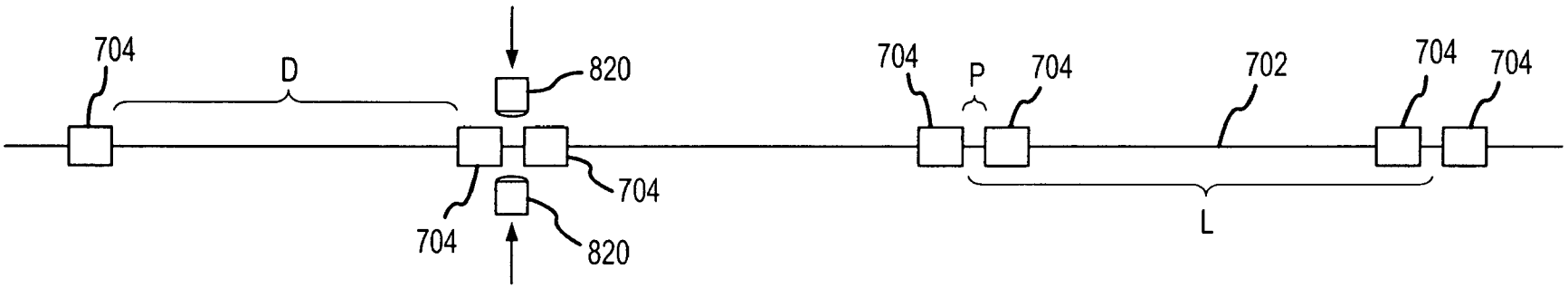
FIG. 9 shows a method of forming the corona charge element according to another embodiment of the invention.

FIG. 9 shows a method of forming the corona charge element 336 according to another embodiment of the invention. The method in this figure comprises forming pairs of retaining bodies 704 on a wire portion 702. The pairs of retaining bodies 704 are separated by a predetermined distance D. A pair of retaining bodies 704 includes a small wire portion P extending between the two retaining bodies 704. The method further comprises shearing the small wire portion P between the two retaining bodies. The shearing can be done by shears or jaws 820. Two shearing operations form an individual corona charge element 336. The corona charge element 336 includes a predetermined length L, a first retaining body formed substantially at a first end of the corona charge element 336, and a second retaining body formed substantially at a second end.

An alternative method for this figure comprises forming the pairs of retaining bodies 704, as previously discussed. The method then comprises shearing between the two retaining bodies 704. As before, the shearing can be done by shears or jaws 820. The shearing embodiment in this embodiment shears away the small wire portion P and a small portion of each retaining body of the two retaining bodies 704. The shearing operation can mash off or peen over the end of the cast retaining body 704 in order to help protect the end of the wire portion 702 an/or to eliminate a sharp cut end of the wire portion 702. As a result, there is no sheared off stub of wire protruding out of the retaining bodies 704, reducing the likelihood of unwanted arcing from the ends of the corona charge elements 336. As before, two shearing operations form the corona charge element 336.

The retaining bodies 704 can be formed on the wire portion 702 in any manner. In one embodiment, the retaining bodies 704 are formed of a malleable material and are crimped onto the wire portion 702. In another embodiment, the retaining bodies 704 are cast on the wire portion 702, such as casting the retaining body material in a liquid, molten, or curable state. Alternatively, the retaining bodies 704 can be bonded to the wire portion 702 by adhesives or bonding agents, or can be welded, ultrasonically welded, brazed, or soldered to the wire portion 702.

Figure 10:
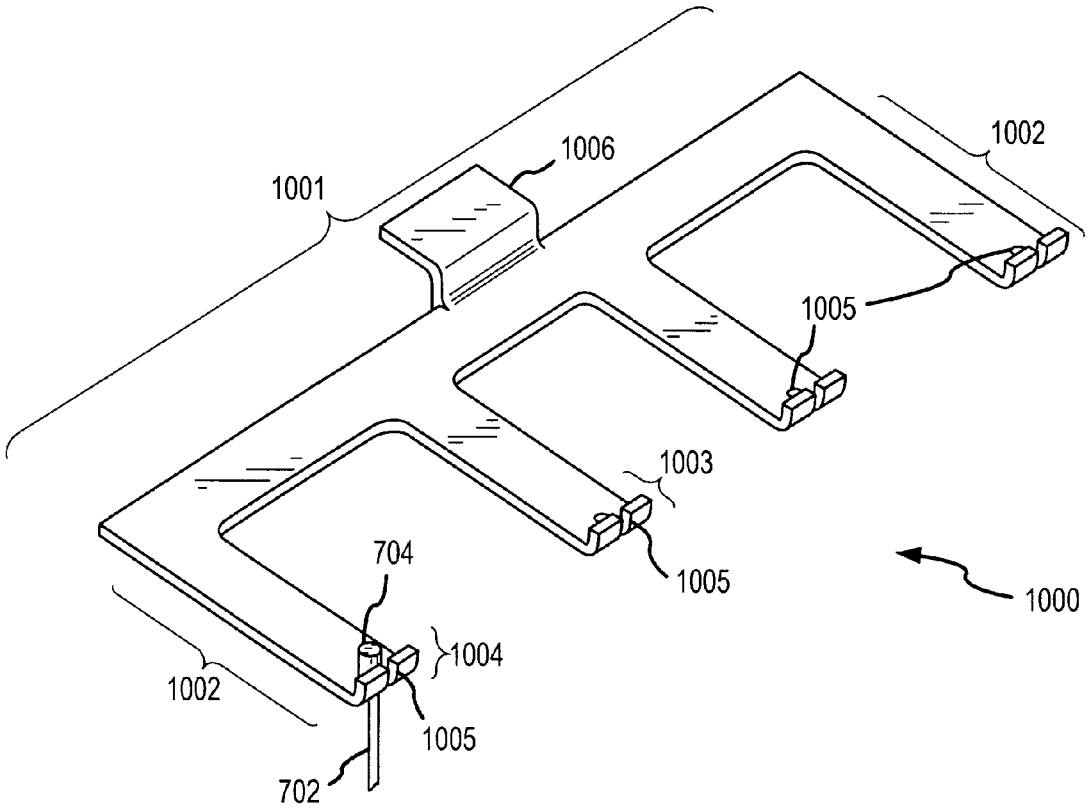
FIG. 10 shows a charge element retaining member according to an embodiment of the invention.

FIG. 10 shows a charge element retaining member 1000 according to an embodiment of the invention. The charge element retaining member 1000 includes a body 1001, flexible arm portions 1002, and a contact pad 1006. The contact pad 1006 can comprise a substantially flat, co-planar region, a raised pad, or a raised region.

The charge element retaining member 1000 in one embodiment is flexible and the flexible arm portions 1002 therefore can bend or deform under pressure. The flexible arm portions 1002 can retain a number of electrode wires of the electrostatic precipitator 300, such as the corona charge elements 336 of the pre-ionizer 330, for example. The flexible arm portions 1002 include a retaining portion 1004 formed on an outer end 1003. The retaining portion 1004 extends from a flexible arm portion 1002, such as at an angle or at a right angle, and includes a slot 1005. The wire portion 702 of a corona charge element 336 fits into the slot 1005, and the retaining body 704 of the corona charge element 336 is held by the retaining portion 1004.

The charge element retaining member 1000 cooperates with the charge element slots 505 of the frame 502 in order to hold the corona charge elements 336. The charge element retaining member 1000 fits into the frame 502, and can be held in the frame 502 by any manner of slots, ears, springs, fasteners, heat staking, welds, etc. In one embodiment, resilient tabs 609 of the frame 502 press the charge element retaining member 1000 against corresponding rails, ears, etc., of the frame 502 in order to retain the charge element retaining member 1000 in the frame 502. The insertion of a corona charge element 336 is further discussed below in conjunction with FIG. 11.

The charge element retaining member 1000 in one embodiment is formed of a flexible, electrically conductive material or at least partially of an electrically conductive material. For example, the charge element retaining member 1000 can be formed of a metal material or a metal alloy. Alternatively, the charge element retaining member 1000 can be formed of a flexible material that includes an electrically conductive layer, such as a metal plating layer. However, it should be understood that the charge element retaining member 1000 can be formed of any suitable material, and various material compositions are within the scope of the description and claims.

Figure 11:
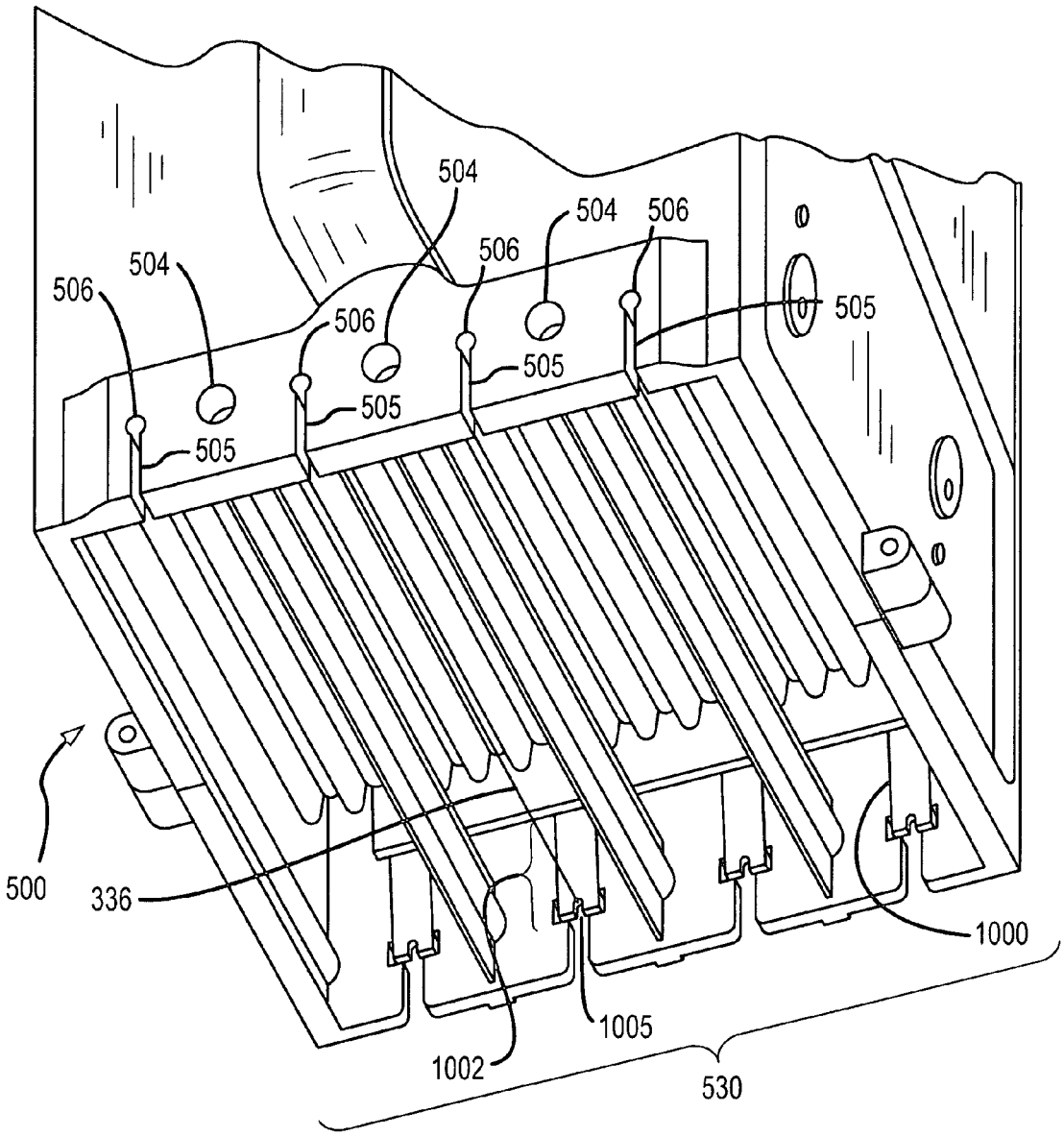
FIG. 11 shows the charge element retaining member assembled to the frame of the electrostatic precipitator assembly.

FIG. 11 shows the charge element retaining member 1000 assembled to the frame 502 of the electrostatic precipitator assembly 500. The frame 502 includes charge element slots 505 on one side of the frame 502 and a charge element retaining member 1000 on an opposite side. One corona charge element 336 is shown in place in a charge element slot 505 in the frame 502 and in the slot 1005 of the charge element retaining member 1000. The charge element retaining member 1000 can be held in position at least partly by the resilient tabs 609 of the frame 502 (see FIG. 6).

To insert the corona charge element 336, one retaining body 704 of the corona charge element 336 (not shown) is inserted into the electrode wire slot 505 of the frame 502. An electrode wire slot 505 receives and traps one retaining body 704 formed on an end of the corona charge element 336. Consequently, the retaining body 704 rests in a bottom region of a corresponding slot well 506. The flexible arm portion 1002 is then depressed from outside the frame 502, and the second retaining body 704 of the corona charge element 336 is slipped behind the retaining portion 1004 of the flexible arm portion 1002, so that the wire portion 702 of the corona charge element 336 fits into the slot 1005 of the flexible arm portion 1002. The flexible arm portion 1002 is then released and the flexible arm portion 1002 springs back into a substantially flat configuration, placing at least a small tensioning force on the corona charge element 336 in order to hold the corona charge element 336 in place.

In one embodiment, a method of retaining an electrode wire 336 in an electrostatic precipitator 300 comprises inserting a first retaining body 704 formed on a first end of the electrode wire 336 into a slot well 506 in an electrostatic precipitator frame 502. The first retaining body 704 is larger than a wire portion 702 of the electrode wire 336. The slot well 506 includes a slot 505 that enables the wire portion 702 of the electrode wire 336 to be inserted into the slot well 506. The method further comprises deforming a flexible arm portion 1002 of an electrode wire retaining member 1000 of the frame 502. The slot well 506 and the flexible arm portion 1002 define the ends of an electrode wire space for the electrode wire 336. The method further comprises placing a second retaining body 704 formed on a second end of the electrode wire 336 into a slot 1005 in the flexible arm portion 1002 and behind a retaining portion 1004 of the flexible arm portion 1002. The method further comprises releasing the flexible arm portion 1002, wherein the flexible arm portion 1002 will return to a substantially normal position, thereby placing a tensioning and retaining force on the electrode wire 336. The method can comprise retaining the electrode wire 336 in an electrostatic precipitator cell 301 or in a pre-ionizer 330 of the electrostatic precipitator 300.

Figure 12:
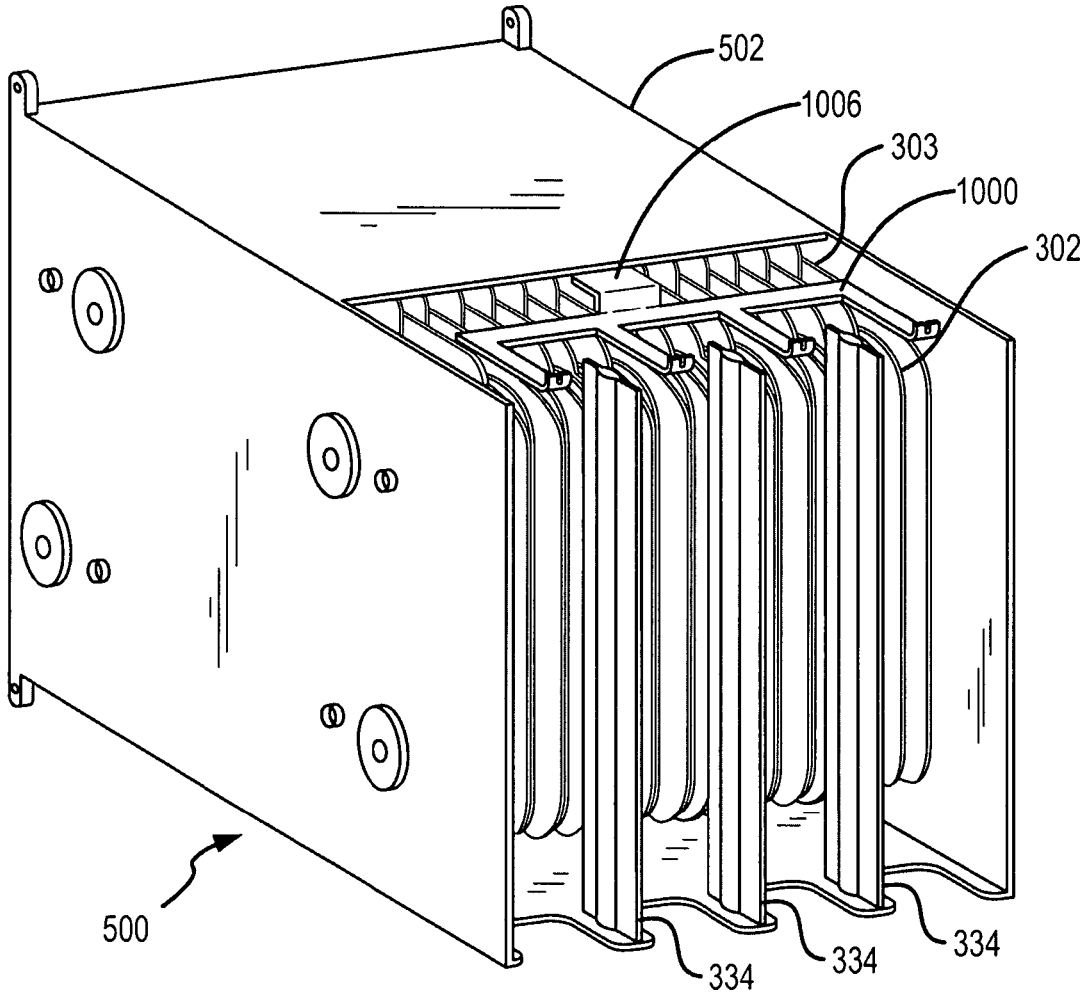
FIG. 12 is a cutout view of the assembled electrostatic precipitator assembly showing the electrode wire retaining member in relation to the frame, the collection plates, and the charge plates, and the corona ground members.

FIG. 12 is a cutout view of the assembled electrostatic precipitator assembly 500 showing the charge element retaining member 1000 in relation to the frame 502, the collection plates 303, the charge plates 302, and the corona ground members 334. It can be seen from this figure that the contact pad 1006 is substantially flush or nearly flush with an exterior surface of the frame 502. Consequently, the contact pad 1006 can receive an electrical voltage through some manner of external voltage transmission contact, including some manner of biased member or spring contact. In addition, it can be seen that the flexible arm portions 1002 of the charge element retaining member 1000 are substantially centered between the corona ground members 334 and side walls of the frame 502.

Figure 13A:
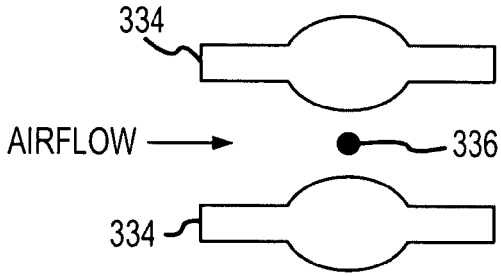
FIGS. 13A-13C show various positional embodiments of the corona ground elements and corona charge elements of the pre-ionizer according to the invention.
Figure 13B:
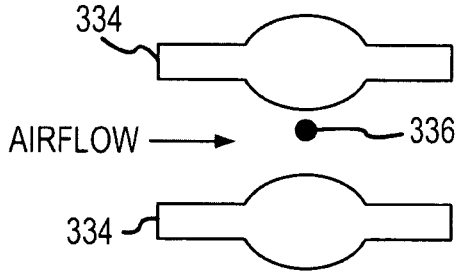
Figure 13C:
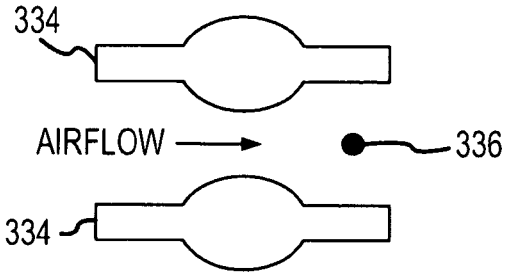

FIGS. 13A-13C show various positional embodiments of the corona ground elements 334 and corona charge elements 336 of the pre-ionizer 330 according to the invention. In FIG. 13A, a corona charge element 336 is substantially centered between corresponding corona ground elements 334. In this embodiment, the corona charge element 336 is both substantially vertically centered and substantially horizontally centered.

In FIG. 13B, the corona charge element 336 is closer to one corona ground element 334. In this embodiment, the corona charge element 336 is not vertically centered.

In FIG. 13C, the corona charge element 336 is located anywhere between the center and an end of the corona ground elements 334. In this embodiment, the corona charge element 336 is not horizontally centered. It should be understood that the above are merely illustrative examples, and a corona charge element 336 can be located anywhere within the pre-ionizer 330 and anywhere in relation to the corona ground elements 334.

Figure 14A:
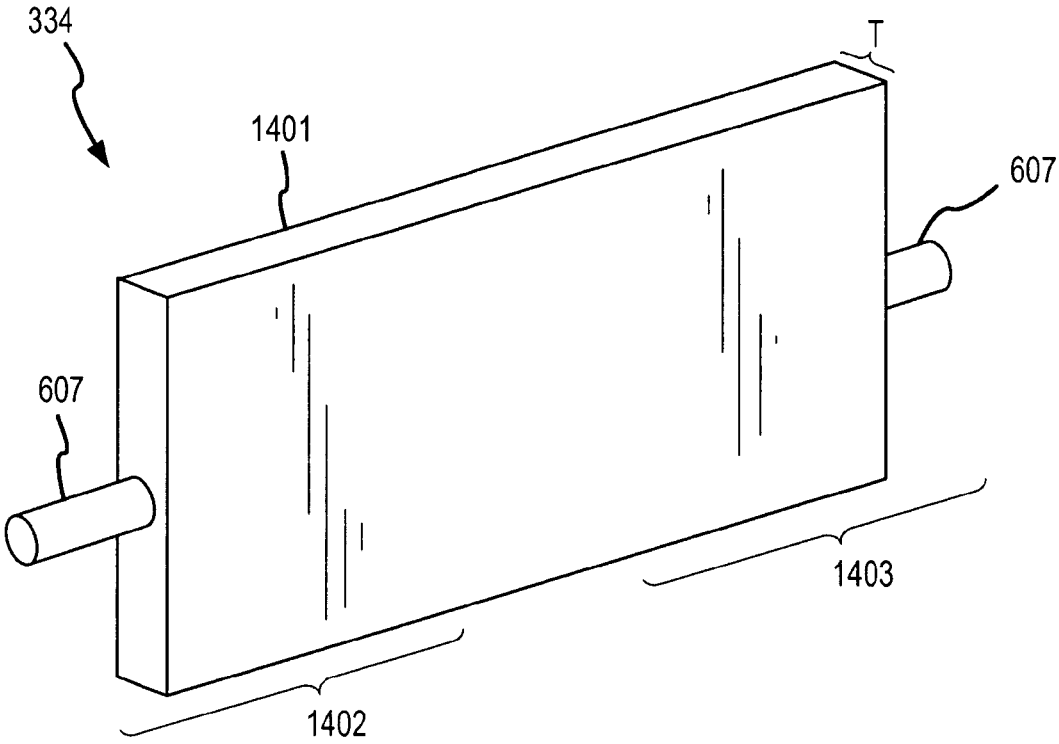
FIGS. 14A-14B show a corona ground element according to two embodiments of the invention.
Figure 14B:
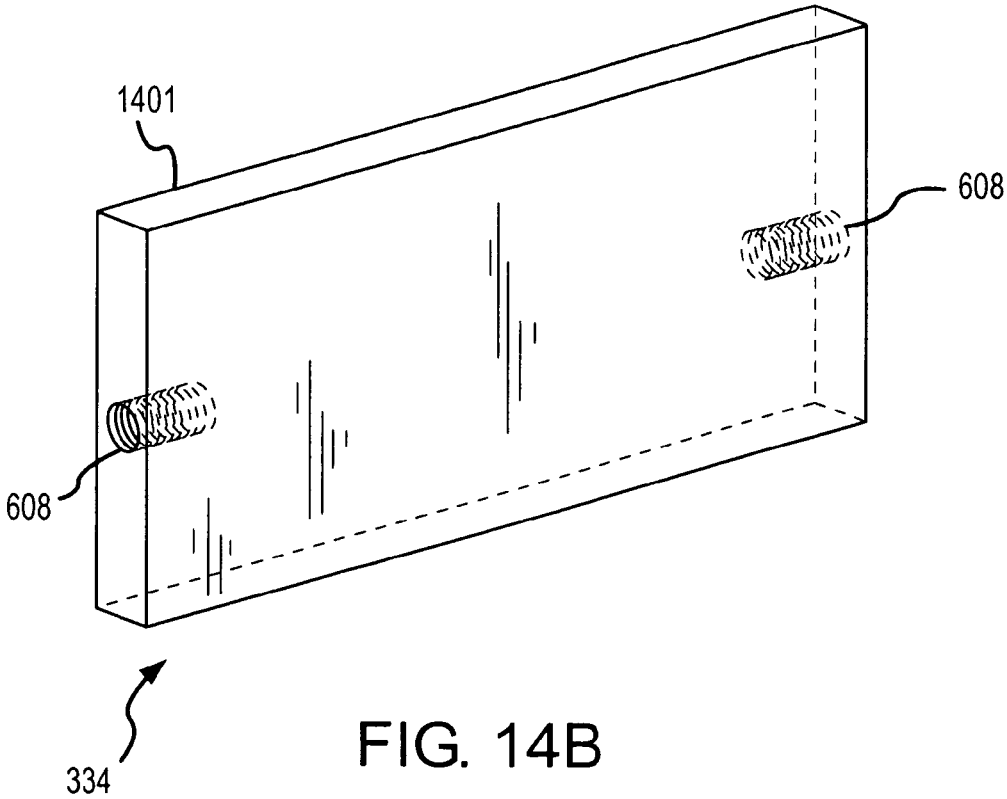

FIGS. 14A-14B show a corona ground element 334 according to two embodiments of the invention. In one embodiment, the corona ground element 334 comprises a corona plate 334, as shown. It should be understood that other shapes can be employed (see FIGS. 15A-15I). In FIG. 14A, the corona plate 334 includes a substantially elongate body 1401 including a proximate end 1402, a distal end 1403, a thickness T, and first and second projections 607 formed on the proximate end 1402 and the distal end 1403. In one embodiment, the projections 607 comprise shafts. In another embodiment, the projections 607 comprise hollow shafts, including shafts with threaded apertures, which can receive some manner of fastener. A fastener can comprise a rivet, screw, bolt, a stud with biased or spring portions, etc.

Figure 15A:
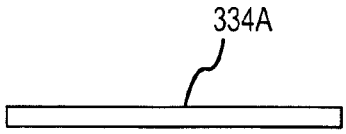
FIGS. 15A-15I show various cross-sectional shapes of a corona ground element according to various embodiments of the invention.
Figure 15B:
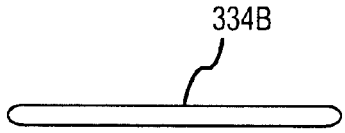
Figure 15C:
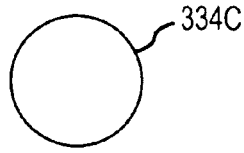
Figure 15D:
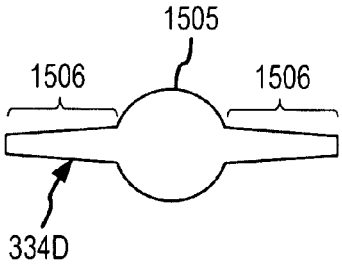
Figure 15E:
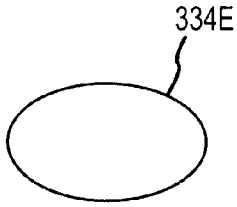
Figure 15F:
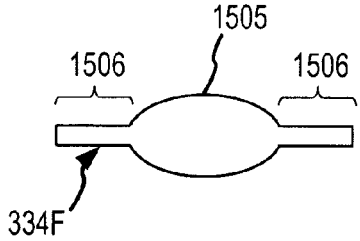
Figure 15G:
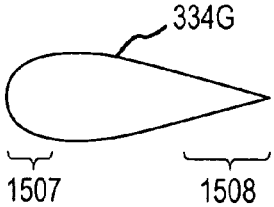
Figure 15H:
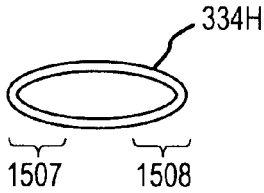

In one embodiment, the corona plate 334 comprises a hollow body, such as a tube (see FIG. 15H). In one embodiment, the projections 607 comprise stub axles or support members that are used to retain the corona plate 334 in the electrostatic precipitator 300. In one embodiment, the projections 607 fit into ground element apertures 504 in the frame 502. The projections 607 may fit only part way into the ground element apertures 504.

FIG. 14B shows an alternative embodiment, wherein the body 1401 includes threaded apertures 608. The threaded apertures 608 receive threaded fasteners that affix the corona ground element 334 in the electrostatic precipitator 300.

FIGS. 15A-15I show various cross-sectional shapes of the corona ground element 334 according to various embodiments of the invention. FIG. 15A shows a corona ground element 334A that has a planar cross-sectional shape, wherein the corona plate 334A can be formed out of sheet material. FIG. 15B shows a corona ground element (plate) 334B that has a planar shape, but with rounded leading and trailing edges. The rounded leading and trailing edges may be desirable in reducing airflow drag and airflow turbulence through the pre-ionizer 330. FIG. 15C shows a corona ground element 334C that has a substantially circular cross-sectional shape. FIG. 15D shows a corona ground element 334D that has a substantially circular central portion 1505 and two substantially planar opposing fins 1506. The fins 1506 can be substantially flat or can be at least partially tapered. In addition, the fins 1506 can include rounded or shaped leading and trailing edges (not shown). FIG. 15E shows a corona ground element 334E that is substantially ovoid or elliptical. FIG. 15F shows a corona ground element 334F that includes a substantially ovoid body 1505 and two substantially planar opposing fins 1506. As before, the fins 1506 can be substantially flat or can be at least partially tapered. FIG. 15G shows a corona ground element 334G that has a substantially tear-drop or airfoil cross-sectional shape, including a rounded leading edge 1507 and a tapered trailing edge 1508. This embodiment can be employed in order to substantially reduce airflow drag and airflow turbulence through the pre-ionizer 330. FIG. 15H shows a corona ground element 334H that has a substantially aerodynamic cross-sectional shape. The corona ground element 334H in one embodiment comprises a substantially symmetrical airfoil shape. The corona ground element 334H can include a substantially rounded leading edge 1507, a substantially rounded trailing edge 1508, or both. Alternatively, the corona ground element can include a substantially tapered trailing edge 1508, as shown in FIG. 15G, and/or a substantially tapered leading edge (not shown). FIGS. 15B and 15D-H comprise embodiments featuring aerodynamic cross-sectional shapes, wherein airflow around these corona ground elements remains substantially turbulence free and smooth due to the cross-sectional shape.

The corona ground element 334H shown in FIG. 15H is substantially hollow, such as a tube, for example. It should be understood that although the various embodiments are depicted as comprising solid shapes, alternatively any of the corona ground element embodiments can comprise a substantially hollow body.

Figure 15I:
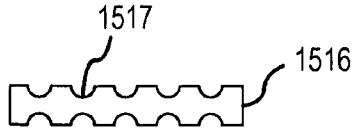

The corona ground element 3341 shown in FIG. 15I comprises a substantially planar body 1516 that includes a plurality of depressions 1517 formed on the body 1516. The depressions 1517 create a maximal surface area. This embodiment can be used wherein the corona ground element 3341 is desired to additionally function as a collector surface for dirt and debris in the pre-ionizer 330.

The various embodiments shown and described above can include the projections 607 shown in FIG. 14A. Alternatively, the various embodiments can be formed without the projections 607, such as with the threaded apertures 608 shown in FIG. 14B. Consequently, the ends of the various embodiments can be received in indentations, depressions, sockets, fixtures, etc., of the frame 502, as the projections 607 are not required for mounting.

Figure 16A:
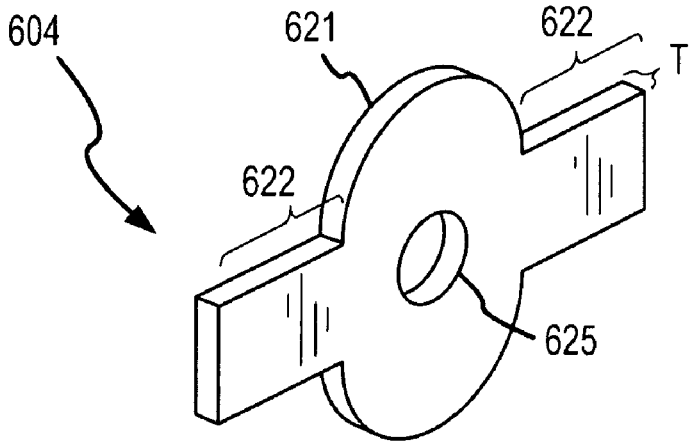
FIGS. 16A-16B show details of a retainer according to an embodiment of the invention.
Figure 16B:
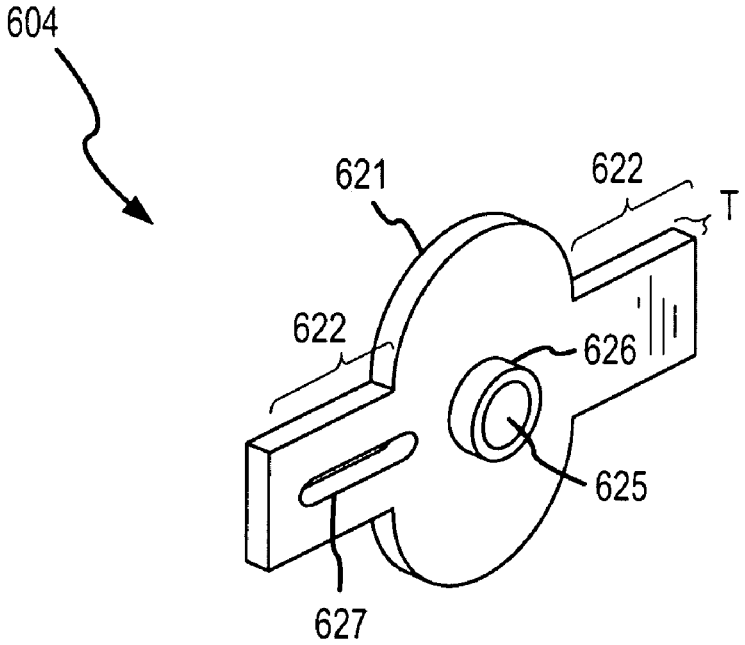
Figure 17:
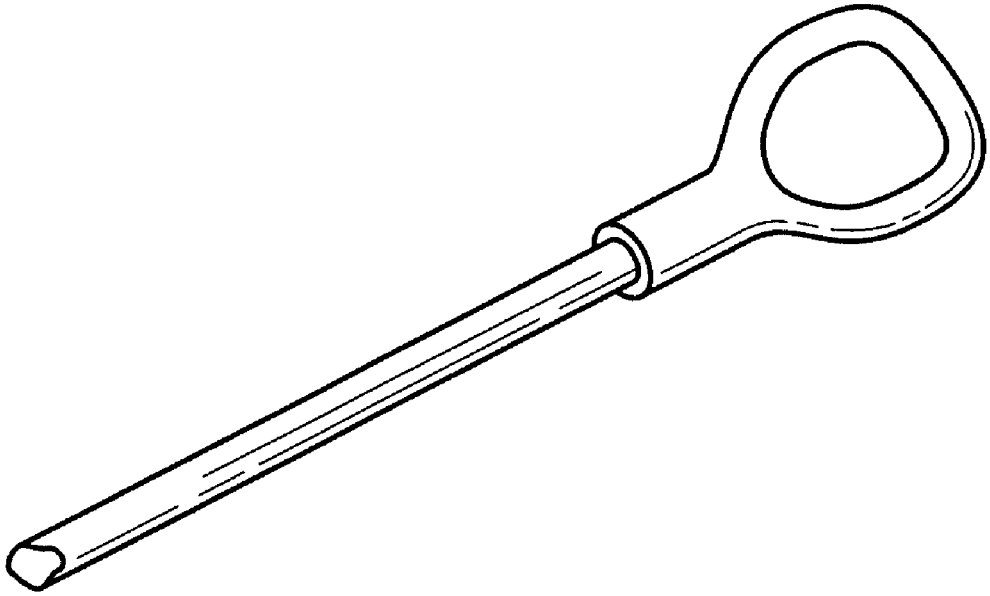
PRIOR ART FIG. 17
FIG. 17 shows a prior art corona wire loop end of a corona wire used in a prior art electrostatic precipitator.

FIGS. 16A-16B show details of the retainer 604 according to an embodiment of the invention. The retainer 604 in the embodiment of FIG. 16A comprises a body including substantially rectangular end portions 622, a substantially circular central portion 621, a thickness T, and a retainer aperture 625. The retainer 604 can be formed of any suitable material, including an at least partially deformable material, an electrically insulating material, an electrically conducting material, etc.

The body in this embodiment is substantially planar. It should be understood that the overall shape is just one embodiment. Other shapes are contemplated and are within the scope of the description and claims.

The retainer aperture 625 can receive a projection 607 of one end of a corona ground element 334. The projection 607 can fit into the retainer aperture 625 in a friction or press fit, wherein the retainer 604 traps and retains the corona ground element 334 in a ground element aperture 504 of the frame 502. The retainer 604, by gripping the corona ground element 334, holds the corona ground element 334 in the frame 502. Alternatively, the retainer 604 can be affixed to the corona ground element 334 by a threaded fastener that passes through the retainer aperture 625 and threads into the threaded aperture 608 (see FIG. 14B).

FIG. 16B shows the retainer 604 according to another embodiment of the invention. In this embodiment, the retainer 604 includes a sleeve portion 626, wherein the sleeve portion 626 can fit at least partially into the ground element aperture 504 of the frame 502. In addition, in some embodiments, the sleeve portion 626 can also fit into the threaded aperture 608 of the corona ground element 334 (see FIG. 14B). It should be understood that the outside surface of the sleeve portion 626 can be smooth, textured, threaded, etc., and can fit into the threaded aperture 608 (the threaded aperture 608 can alternatively be smooth or textured in some manner). The sleeve portion 626 can be substantially cylindrical, or can be at least partially tapered. The sleeve portion can include the retainer aperture 625, wherein the retainer aperture 625 extends at least partially through the sleeve portion 626. The thickness of the sleeve portion 626 can taper away from the body of the retainer 604. The retainer 604 of this embodiment can be retained in the ground element aperture 504 of the frame 502 by a friction or press fit provided by an outer surface of the sleeve portion 626. As was previously discussed, a projection 607 of the corona ground element 334 fits inside the retainer aperture 625, and can fit loosely or can be gripped by the retainer 604. The retainer 604 in this embodiment therefore retains the corona ground element 334 by gripping the frame 502.

Alternatively, in another embodiment, the retainer aperture 625 can extend completely through the body and the sleeve portion 626. Consequently, as was previously discussed, the retainer aperture 625 can receive a fastener that affixes (or removably affixes) the retainer 604 to a corona ground element 334.

The retainer 604 of any embodiment can optionally include one or more alignment devices 627. An alignment device 627 can comprise some manner of projection that fits to and interacts with some manner of depression of the frame 502, such as a slot, groove, etc., in order to prevent movement or rotation of a corona ground element 334. For example, the alignment device 627 can comprise the alignment rib 627 shown in FIG. 16B. Alternatively, the one or more alignment devices 627 can comprise bumps, shafts, shapes, some manner of knurling, texturing or roughening, fins, blocks, etc. Alternatively, in another embodiment, an alignment device 627 can comprise some manner of depression that fits to a corresponding projection on the frame 502.

In one embodiment of the invention, the retainer 604 is affixed or removably affixed to the corona ground element 334 by some manner of fastener, such as a threaded fastener, for example. The fastener can pass through the retainer aperture 625. In some embodiments, the retainer 604 can be clamped against the frame 502 by this fastener.

The electrostatic precipitator according the invention can be implemented according to any of the embodiments in order to obtain several advantages, if desired. The invention can provide an effective and efficient electrostatic precipitator type air cleaner device. Advantageously, a pre-ionizing electrical field is created in front of or upstream of the electrostatic precipitator cell. As a result, the airflow will be uniformly pre-ionized before it reaches the electrostatic precipitator cell. Another advantage of the invention is that the pre-ionizing electrical field extends substantially perpendicularly to the airflow, resulting in a wider and more uniform electrical field to be traversed by the airflow and any entrained particulate. Another advantage of the invention is that the voltage potential capable of being generated in the pre-ionizer can be much higher than the voltage level on the charge plates of the electrostatic precipitator cell. The ionization level of the pre-ionizer may therefore be much more effective and efficient than the ionization created by the charge plates and the collection plates alone. Another advantage of the invention is that particulate entrained in the airflow will be at least partially charged when the airflow first encounters the leading edge of the collection plates. Therefore, the leading edge and leading portion of the collection plates will be more effective and will attract more charged particulate. Another advantage of the invention is that the voltage potential placed across the pre-ionizer can be independent of the voltage potential applied to the electrostatic precipitator cell.

The charge element retaining member according to the invention provides a retaining member that provides a tensioning force. The charge element retaining member can hold multiple charge elements. The charge element retaining member is economical and easy to manufacture, such as by stamping. The charge element retaining member enables easy installation and removal of the charge elements.

The charge element and method according to the invention provide an economical and easy to manufacture electrode wire. The method provides a reliable, mass-produced charge element. The charge element formed according to a method of the invention can be manufactured without any leftover stub wire portions, reducing the probability of unwanted arcing.

The retainer according to the invention provides a reliable and economical device for retaining a corona ground element in an electrostatic precipitator. The retainer can advantageously be installed without the need for tools. The retainer can advantageously operate through a friction or press fit.

What is claimed is:

1. A retainer adapted for use with a corona ground element of an electrostatic precipitator, the retainer comprising:

a substantially planar body including a substantially circular central portion and one or more substantially rectangular end portions extending from the central portion; and a retainer aperture extending at least partially through the body and adapted to receive a projection extending from the corona ground element, wherein the retainer aperture is configured to receive the projection as a press fit.

2. The retainer of claim 1, with the retainer being formed of an at least partially deformable material.

3. The retainer of claim 1, further comprising one or more alignment devices formed on the body.

4. A retainer adapted for use with a corona ground element of an electrostatic precipitator, the retainer comprising:

a substantially planar body including a substantially circular central portion and one or more substantially rectangular end portions extending from the central portion;

a substantially cylindrical sleeve portion extending from the body and adapted to fit into a ground element aperture of the electrostatic precipitator; and a retainer aperture extending at least partially through the sleeve portion and adapted to receive a projection extending from the corona ground element.

5. The retainer of claim 4, with the sleeve portion being of a size to fit into the ground element aperture.

6. The retainer of claim 4, with the sleeve portion being of a size to require a press fit into the ground element aperture.

7. The retainer of claim 4, with the retainer aperture extending completely through the sleeve portion and the body of the retainer, wherein the retainer aperture is adapted to receive a fastener.

8. The retainer of claim 4, wherein the projection of the corona ground element is forced into the retainer aperture as a press fit.

9. The retainer of claim 4, with the retainer being formed of an at least partially deformable material.

10. The retainer of claim 4, further comprising one or more alignment devices formed on the body.

11. A method of forming a retainer for use with a corona ground element of an electrostatic precipitator, the method comprising:

forming a substantially planar body including a substantially circular central portion and one or more substantially rectangular end portions extending from the central portion; and forming a retainer aperture extending at least partially through the body and adapted to receive a projection extending from the corona ground element, wherein the retainer aperture is configured to receive the projection as a press fit.

12. The method of claim 11, with the forming the body comprising forming the body of an at least partially deformable material.

13. The method of claim 11, further comprising forming one or more alignment devices on the body.

14. A method of forming a retainer for use with a corona ground element of an electrostatic precipitator, the method comprising:

forming a substantially planar body including a substantially circular central portion and one or more substantially rectangular end portions extending from the central portion;

forming a substantially cylindrical sleeve portion extending from the body and adapted to fit into a ground element aperture of the electrostatic precipitator; and forming a retainer aperture extending at least partially through the sleeve portion and configured to receive a projection extending from the corona ground element.

15. The method of claim 14, with the sleeve portion being formed of a size to fit into the ground element aperture.

16. The method of claim 14, with the sleeve portion being formed of a size to require a press fit into the ground element aperture.

17. The method of claim 14, with the retainer aperture extending completely through the sleeve portion and the body of the retainer, wherein the retainer aperture is adapted to receive a fastener.

18. The method of claim 14, wherein the retainer aperture is configured to receive the projection of the corona ground element as a press fit.

19. The method of claim 14, with the forming the body comprising forming the body of an at least partially deformable material.

20. The method of claim 14, further comprising forming one or more alignment devices on the body.

* * * * *